US011508341B2

(12) United States Patent
Suzuki

(10) Patent No.: US 11,508,341 B2
(45) Date of Patent: Nov. 22, 2022

(54) KEYBOARD DEVICE FOR KEYBOARD INSTRUMENT

(71) Applicant: KABUSHIKI KAISHA KAWAI GAKKI SEISAKUSHO, Hamamatsu (JP)

(72) Inventor: Akihiro Suzuki, Hamamatsu (JP)

(73) Assignee: KABUSHIKI KAISHA KAWAI GAKKI SEISAKUSHO, Hamamatsu (JP)

( * ) Notice: Subject to any disclaimer, the term of this patent is extended or adjusted under 35 U.S.C. 154(b) by 0 days.

(21) Appl. No.: 17/406,791

(22) Filed: Aug. 19, 2021

(65) Prior Publication Data

US 2022/0084484 A1 Mar. 17, 2022

(30) Foreign Application Priority Data

Sep. 14, 2020 (JP) ..... JP2020-153438

(51) Int. Cl.
*G10C 3/18* (2006.01)
*G10C 3/12* (2006.01)
*G10H 1/34* (2006.01)

(52) U.S. Cl.
CPC ..... *G10C 3/18* (2013.01); *G10C 3/12* (2013.01); *G10H 1/344* (2013.01)

(58) Field of Classification Search
CPC ..... G10H 1/344; G10C 3/18
See application file for complete search history.

(56) References Cited

U.S. PATENT DOCUMENTS 5,612,502 A * 3/1997 Ura ..... G10H 1/344 84/719
8,247,672 B2 * 8/2012 James ..... G10C 3/00 84/255
8,927,848 B2 * 1/2015 Kaneko ..... G10H 1/34 84/720
9,082,372 B2 * 7/2015 Suzuki ..... G10C 3/12
9,613,608 B2 * 4/2017 Osuga ..... G10H 1/34
9,940,916 B2 * 4/2018 Suzuki ..... G10H 1/346
10,115,382 B2 * 10/2018 Nishimura ..... G10H 1/346
(Continued)

FOREIGN PATENT DOCUMENTS

JP 2009-75404 4/2009

*Primary Examiner* — Robert W Horn
(74) *Attorney, Agent, or Firm* — Lewis Roca Rothgerber Christie LLP

(57) ABSTRACT

A keyboard device for a keyboard instrument, capable of largely reducing noise generated when a hammer contacts a lower limit stopper during key release immediately after key depression. The keyboard device includes a keyboard chassis disposed on a keybed, keys pivotally supported on the chassis, hammers pivotally supported on the chassis below the keys and each vertically pivotally moved, an intermediate rail mounted on the chassis below a rotational shaft of the hammers and its vicinity in a state floating from the keybed, and a lower limit stopper mounted on the intermediate rail, such that each hammer is placed thereon via its placement-contact portion when in a key-released state and contacts the same from above via the placement-contact portion when pivotally moving downward in accordance with key release after being moved upward by key depression, whereby further pivotal motion of the hammer is stopped.

4 Claims, 3 Drawing Sheets

(56) References Cited

U.S. PATENT DOCUMENTS

| | | | | |
|---|---|---|---|---|
| 10,347,223 | B2 * | 7/2019 | Taniguchi | G10C 3/18 |
| 10,418,003 | B2 * | 9/2019 | Taniguchi | G10C 3/04 |
| 10,902,830 | B2 * | 1/2021 | Nishida | G10H 1/46 |
| 11,037,542 | B2 * | 6/2021 | Okamoto | G10H 1/346 |
| 2022/0084484 | A1 * | 3/2022 | Suzuki | G10H 1/344 |

* cited by examiner

KEYBOARD DEVICE FOR KEYBOARD INSTRUMENT

CROSS-REFERENCE TO RELATED APPLICATION(S)

This application claims priority to Japanese Patent Application Number 2020-153438, filed on Sep. 14, 2020, the entire content of which is incorporated herein by reference.

BACKGROUND OF THE INVENTION

Field of the Invention

The present invention relates to a keyboard device for a keyboard instrument including a hammer which is applied to a keyboard instrument, such as an electronic piano, and is configured to be pivotally moved in accordance with depression of a key.

Description of the Related Art

Conventionally, as this kind of a keyboard device for a keyboard instrument, there has been known, for example, one disclosed in Japanese Laid-Open Patent Publication (Kokai) No. 2009-75404. In this keyboard device, a key frame as a keyboard chassis is disposed on a key frame bottom board as a keybed. Keys are arranged on an upper side of the key frame, and mass bodies as hammers are arranged inside the key frame. The keys extend in a front-rear direction, and has rear ends thereof pivotally supported on a rear end of an upper surface of the key frame. On the other hand, the mass bodies extend in the front-rear direction and each have an arm having a front portion pivotally supported by the key frame and a main body as a weight mounted to a rear end of the arm. Further, at a predetermined location of the key frame bottom board, there is provided a lower limit stopper for restricting lower limit positions of the mass bodies which vertically pivotally move.

In the above-described keyboard device, when a front end of a key is pressed down for key depression, a front end of an arm of an associated mass body is depressed, accordingly. With this, the mass body is pivotally moved such that the main body at the rear end of the mass body is moved upward, whereby the mass body reaches an upper limit position. Then, when the finger is released from the key being depressed, for key release, the depression of the front end of the arm is released, whereby the mass body pivotally moves such that the main body positioned at the upper limit position moves downward. As a consequence, the main body or the rear end of the arm contacts the lower limit stopper from above, whereby further pivotal motion of the mass body is blocked.

As described above, in the conventional keyboard device, during key release immediately after key depression, a portion of the mass body relatively far away from a pivot thereof, more specifically, the main body of the mass body or the rear end of the arm moves into contact with the lower limit stopper from above. In this case, a height of the main body at the start of the downward movement thereof, that is, a distance between the main body located at the upper limit position and the lower limit stopper is relatively large, and hence the speed of the main body and the impact thereof on the lower limit stopper when the main body or the like moves into contact with the lower limit stopper are large, so that noise is liable to be generated by the contact. Further, since the lower limit stopper is mounted on the key frame bottom board as the keybed, when the main body or the like moves into contact with the lower limit stopper, vibration and noise generated by the contact are directly transmitted to the key frame bottom board, and more widely spread to surroundings via the key frame bottom.

SUMMARY OF THE INVENTION

It is an object of the present invention to provide a keyboard device for a keyboard instrument, which is capable of largely reducing noise generated when a hammer contacts a lower limit stopper during key release immediately after key depression.

To attain the above object, the present invention provides a keyboard device for a keyboard instrument, including a keybed, a keyboard chassis disposed on the keybed, a plurality of keys each extending in a front-rear direction and pivotally supported on the keyboard chassis, the keys being arranged side by side in a left-right direction, a plurality of hammers each extending in the front-rear direction and pivotally supported on the keyboard chassis below the plurality of keys, the hammers being arranged side by side in the left-right direction and being vertically pivotally moved in accordance with depression of associated ones of the keys, respectively, an extension rail extending below a rotational shaft of the plurality of hammers and its vicinity along an entirety of the plurality of hammers in the left-right direction, the extension rail being mounted on the keyboard chassis in a state floating from the keybed, and a lower limit stopper which is mounted on the extension rail and on which each of the plurality of hammers is placed via a predetermined placement-contact portion thereof when in a key-released state, the lower limit stopper blocking further pivotal motion of the hammer by having the hammer contact itself from above when the hammer pivotally moved upward by key depression pivotally moves downward in accordance with key release.

With this construction, the plurality of keys each extending in the front-rear direction and the plurality of hammers disposed below the plurality of keys are pivotally supported on the keyboard chassis mounted on the keybed and are arranged side by side in the left-right direction. The hammers are vertically pivotally moved in accordance with depression of associated ones of the keys, respectively. Further, the extension rail, which extends below the rotational shaft of the plurality of hammers and its vicinity along the entirety of the hammers in the left-right direction, is mounted on the keyboard chassis in the state floating from the keybed. Furthermore, the lower limit stopper is mounted on the extension rail. Each hammer is placed on the lower limit stopper via the predetermined placement-contact portion thereof when in the key-released state. Further, when the hammer pivotally moved upward by key depression pivotally moves downward in accordance with key release, the lower limit stopper has the placement-contact portion of the hammer contact itself from above.

The above-described lower limit stopper is mounted on the extension rail, and hence differently from the conventional keyboard device in which a portion far away from a rotational shaft of a hammer moves into contact with a lower limit stopper, the placement-contact portion of the hammer moves into contact with the lower limit stopper disposed at a location relatively close to the rotational shaft of the hammer. With this, when the hammer starts to pivotally move downward at the time of key release immediately after key depression, a distance between the placement-contact portion and the lower limit stopper is relatively short, which reduces the speed of the placement-contact portion of the hammer and the impact thereof on the lower limit stopper when the placement-contact portion of the hammer moves into contact with the lower limit stopper. As a result, compared with the conventional keyboard device, it is possible to reduce noise generated by the contact. Further, the extension rail having the lower limit stopper mounted thereon is mounted on the keyboard chassis in the state floating from the keybed, so that when the hammer pivotally moves downward into contact with the lower limit stopper, vibration and noise generated by the contact cannot be directly transmitted to the keybed. As described above, the lower limit stopper with which the hammer moves into contact is disposed below the rotational shaft of the hammer and its vicinity and is also mounted on the extension rail in the state floating from the keybed, whereby compared with the conventional keyboard device, it is possible to largely reduce noise generated when the hammer contacts the lower limit stopper.

Preferably, the lower limit stopper extends along a longitudinal direction of the extension rail and is disposed along the entirety of the plurality of hammers.

With the construction of this preferred embodiment, since the lower limit stopper of the extension rail extends along the longitudinal direction of the extension rail, and is disposed along the entirety of the plurality of hammers, it is possible to easily form the lower limit stopper associated with all the hammers, by a single member. Further, compared with a case where during manufacturing of a keyboard device, an individual lower limit stopper is mounted on an extension rail on a hammer-by-hammer basis, it is possible to improve manufacturing efficiency.

Preferably, each of the plurality of hammers has a predetermined length from the rotational shaft to a rear end thereof, and the lower limit stopper is disposed on the extension rail such that the placement-contact portion of the hammer is located closer to the rotational shaft than a location corresponding to half of the predetermined length is.

With the construction of this preferred embodiment, the lower limit stopper is disposed on the extension rail such that the placement-contact portion of the hammer having the predetermined length from the rotational shaft to the rear end thereof is located closer to the rotational shaft than the location corresponding to half of the predetermined length (hereinafter referred to as "the center position" in this section) is. As described above, the placement-contact portion, which is located closer to the rotational shaft than the center position of the hammer is, moves into contact with the lower limit stopper, and hence compared with e.g. a case where a portion of the hammer, which is located closer to the rear end than the center position of the hammer is, moves into contact with the lower limit stopper, it is possible to positively reduce the distance between the placement-contact portion and the lower limit stopper at the start of the downward pivotal motion of the hammer. With this, it is possible to reduce the speed of the hammer and the impact thereof on the lower limit stopper when the hammer moves into contact with the lower limit stopper to thereby ensure reduction of noise.

Preferably, the lower limit stopper is formed of an elastic material.

With the construction of this preferred embodiment, since the lower limit stopper is formed of an elastic material, it is possible to reduce the impact of the hammer when the hammer contacts the lower limit stopper to thereby further reduce noise generated by the contact.

The above and other objects, features, and advantages of the present invention will become more apparent from the following detailed description taken in conjunction with the accompanying drawings.

BRIEF DESCRIPTION OF THE DRAWINGS

FIGS. 1A and 1B are diagrams showing a keyboard device for an electronic piano according to an embodiment of the present invention, in a key-released state, in which FIG. 1A is a side view and FIG. 1B is an enlarged view of a portion encircled by a one-dot chain line in FIG. 1A;

FIGS. 3A and 3B are views useful in explaining operation of a hammer at the time of key depression, in which FIG. 3A shows a state where a white key is depressed and FIG. B shows a state in which the depressed white key is released.

DETAILED DESCRIPTION OF PREFERRED EMBODIMENTS

Figure 1A:
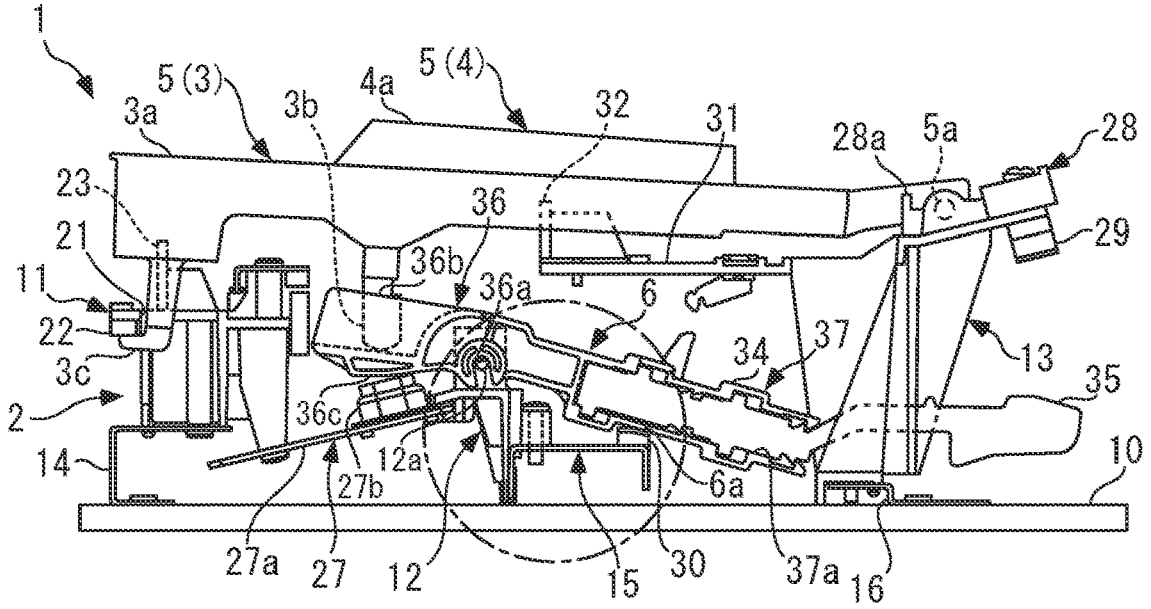
Figure 2:
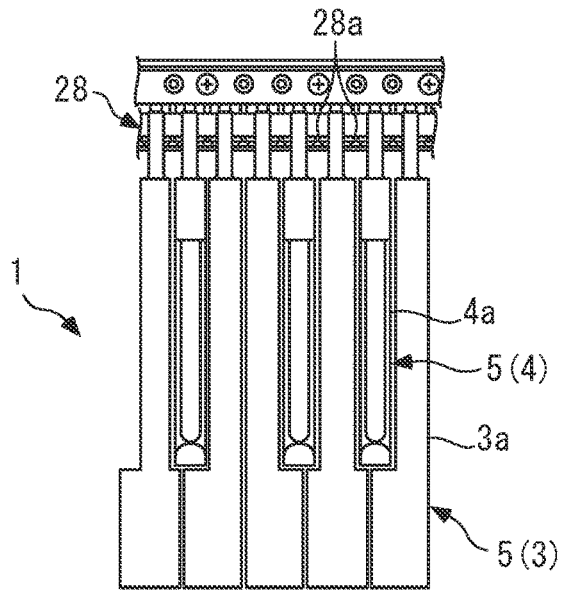
FIG. 2 is a plan view of a portion of the keyboard device.

The present invention will now be described in detail with reference to the drawings showing preferred embodiments thereof. FIGS. 1A and 2 show a keyboard device for an electronic piano according to an embodiment of the present invention. As shown in FIGS. 1A and 2, the keyboard device 1 is comprised of a keyboard chassis 2, a plurality of keys 5 (e.g. eighty-eight keys, of which only eight keys are shown in FIG. 2), which include white keys 3 and black keys 4 pivotally mounted on the keyboard chassis 2, and a plurality of hammers 6 each pivotally mounted on the keyboard chassis 2 for an associated one of the keys 5. Note that in the following description, if the white keys 3 and the black keys 4 are not particularly distinguished from each other, they will be simply referred to as the keys 5.

The keyboard chassis 2 is formed by a plurality of molded articles arranged in parallel with each other in a left-right direction (in a depth direction as viewed in FIGS. 1A and 1*n* a left-right direction as viewed in FIG. 2), which are made e.g. by injection molding of a predetermined resin material (e.g. an ABS resin) into a predetermined shape for each octave. Referring to FIG. 1A, the keyboard chassis 2 has a front portion (left portion as viewed in FIG. 1A) 11, an intermediate portion 12, and a rear portion (right portion as viewed in FIG. 1A) 13 integrally formed with each other in a state connected to each other by ribs, not shown. Further, the front portion 11, the intermediate portion 12, and the rear portion 13 have their plurality of molded articles of the keyboard chassis 2 made for each octave, connected to each other via a front-side rail 14, an intermediate rail 15 (extension rail), and a rear-side rail 16, which extend in the left-right direction, respectively. In addition, the front portion 11 and the rear portion 13 are fixed to a keybed 10 via the front-side rail 14 and the rear-side rail 16, respectively. Note that in the following description, the front portion 11, the intermediate portion 12, and the rear portion 13 of the keyboard chassis 2 are referred to as "the chassis front 11", "the chassis intermediate portion 12", and "the chassis rear 13", respectively.

The chassis front 11 has a plurality of pairs of engagement holes 21 provided for each associated one of the white keys 3, each pair being formed by two engagement holes 21 left and right (only one of which is shown in FIG. 1A) vertically extending through the chassis front 11. Left and right upper limit position regulation portions 3*c*, referred to hereinafter, of the associated white key 3 are engaged with the engagement holes 21 in a state inserted therethrough respectively. Further, the chassis front 11 has a white key-associated key stopper 22 attached to a lower edge thereof forward of the engagement holes 21, for restricting the upper limit position of each white key 3. The upper limit position regulation portions 3*c* of the white key 3 move into contact with the white key-associated key stopper 22 from below when in a key-released state, whereby the upper limit position of the white key 3 is restricted. Furthermore, the chassis front 11 has a plurality of white key-associated key guides 23 erected therefrom in association with the respective white keys 3. During pivotal motion of the white keys 3, these white key-associated key guides 23 each vertically guide the front end of the white key 3 and prevent lateral swing of the white key 3.

The chassis intermediate portion 12 has a pivot shaft 12*a* (rotational shaft) extending in the left-right direction, and the hammers 6 are pivotally supported on the pivot shaft 12*a*. Further, key switches 27 extending toward the chassis front 11 are mounted on the chassis intermediate portion 12, for each detecting key depression information on an associated one of the keys 5. The key switches 27 are formed by a printed circuit board 27*a* and switch bodies 27*b* formed by rubber switches attached to the printed circuit board 27*a* on a key-by-key basis. The key switches 27 are mounted on the keyboard chassis 2 in a state in which a rear end of the printed circuit board 27*a* is inserted into the chassis intermediate portion 12 and a front end of the same is screwed to the chassis front 11.

The chassis rear 13 has a key support section 28 that supports a pivot shaft 5*a*, referred to hereinafter, provided on a rear end of each key 5, to thereby support the key 5 such that the key 5 is pivotally movable about the pivot shaft 5*a*. Further, an upper limit stopper 29 for restricting the upper limit position of an associated one of the hammers 6 is attached to a rear end of a lower surface of the key support section 28. Furthermore, a front end of the key support section 28 has a rear-side key guide 28*a* erected therefrom between the rear ends of each adjacent two of the keys 5 and 5. Each two of the rear-side key guides 28*a* and 28*a* prevent lateral swing of the rear end of one of the keys 5 located therebetween.

Between the chassis rear 13 and the chassis intermediate portion 12, there is provided a flat plate 31 extending substantially horizontally between the keys 5 and the hammers 6. This flat plate 31 has a plurality of intermediate key guides 32 (only one of which is shown in FIG. 1A) erected from the front end for each black key 4 so as to vertically guide the black key 4 and prevent lateral swing of the same during pivotal motion thereof.

Each key 5 is formed e.g. by injection molding of a predetermined resin material (e.g. AS resin) such that it extends in a front-rear direction (in a left-right direction as viewed in FIG. 1A) and has an inverted U shape opening downward in transverse cross-section. Further, the key 5 has a key body (key body 3*a* of the white key 3 or key body 4*a* of the black key 4) which is pivotally movably supported on the keyboard chassis 2 such that the key body can be pivotally moved about the pivot shaft 5*a* protruding from the left and right sides of the rear end thereof.

As shown in FIG. 1A, the white key 3 has an actuator portion 3*b*, which protrudes downward over a predetermined length, at a predetermined location forward of a central portion of the key body 3*a* in the front-rear direction. The actuator portion 3*b* is engaged with an engagement recess 36*b*, referred to hereinafter, of the hammer 6 in a state received therein. Further, the white key 3 has the pair of left and right upper limit position regulation portions 3*c* and 3*c* (only one of which is shown in FIG. 1A) which protrude downward from a front end of the key body 3*a* over a predetermined length and each have a lower end thereof bent forward. The upper limit position regulation portions 3*c* and 3*c* are engaged with the respective engagement holes 21 and 21 formed through the chassis front 11 in a state inserted therethrough.

On the other hand, the black key 4 has an actuator portion (not shown), which protrudes downward from a front end thereof over a predetermined length. Similar to the actuator portion 3*b* of the white key 3, the actuator portion of the black key 4 is engaged with the associated engagement recess 36*b* of the hammer 6 in a state received therein.

As shown in FIG. 1A, the hammer 6 is comprised of a hammer body 34 and a weight 35 removably attached thereto. The hammer body 34 is formed as a resin molded article which is made e.g. by injection molding of a predetermined resin material (e.g. polyacetal resin) into a predetermined shape. The hammer body 34 extends in the front-rear direction, and has a bearing portion 36*a* formed at a predetermined location in a front half (left half, as viewed in FIG. 1A) 36 of the hammer body 34. The bearing portion 36*a* has an inverted U shape open downward in side view, and is pivotally engaged with the pivot shaft 12*a* of the chassis intermediate portion 12. Further, the engagement recess 36*b* for engagement with the actuator portion 3*b* of the white key 3 or the black key 4 is formed in the front half 36 of the hammer body 34 at a location forward of the bearing portion 36*a*. The engagement recess 36*b* is open upward and forward, and as for the white key 3, the lower portion of the actuator portion 3*b* is received in the engagement recess 36*b* in a state in which a lower end of the actuator portion 3*b* is in contact with a bottom surface of the engagement recess 36*b*. Furthermore, a switch pressing portion 36*c* for pressing the switch body 27*b* of the key switch 27 is provided below the engagement recess 36*b* in the front half 36 of the hammer body 34

A weight mounting portion 37 forming a rear half of the hammer body 34 has an opening 37*a* open rightward (toward the near side as viewed in FIG. 1A), and the weight 35 is removably mounted on the hammer body 34 via the opening 37*a*.

On the other hand, the weight 35 is formed of a material (metal such as steel) larger in specific gravity than the hammer body 34. The weight 35 is formed by pressing a metal plate having a smaller thickness than the thickness (thickness in the depth direction as viewed in FIG. 1A) of the hammer body 34 into a predetermined shape. The weight 35 extends in the front-rear direction, with a front half thereof mounted to the weight mounting portion 37 of the hammer body 34 and a rear half thereof extending rearward to the vicinity of a rear end of the chassis rear 13.

Next, the intermediate rail 15 and a lower limit stopper 30 mounted on the keyboard chassis 2 will be described with reference to FIG. 1B. The intermediate rail 15 is mounted on the chassis intermediate portion 12 of the keyboard chassis 2 below the pivot shaft 12*a* as the rotational shaft of the hammer 6 and its vicinity, and the lower limit stopper 30 for restricting the lower limit position of the hammer 6 is mounted on a rear end (right end as viewed in FIG. 1B) of the upper surface of the intermediate rail 15.

The intermediate rail 15 is made of a predetermined metal (e.g. galvanized steel plate (SECC) or aluminum alloy), and is formed in a C shape opening downward in transverse cross-section by a front wall 15*a*, an upper wall 15*b*, and a rear wall 15*c* thereof. Further, the intermediate rail 15 has a front end of the upper wall 15*b* thereof screwed to the chassis intermediate portion 12 by a mounting screw 38 in a state in which the front wall 15*a* is in intimate contact with a drooping wall 12*b* of the chassis intermediate portion 12 from rear. The front wall 15*a* of the intermediate rail 15 is sandwiched in the front-rear direction between the drooping wall 12*b* of the chassis intermediate portion 12 and a clip member 39 fitted from below. Note that the clip member 39 is made of rubber or synthetic resin and is configured such that vibration from the chassis intermediate portion 12 toward the keybed 10 can be suppressed. Further, the clip member 39 may be configured such that a nonwoven fabric or a felt is affixed thereto as a buffer.

Figure 1B:
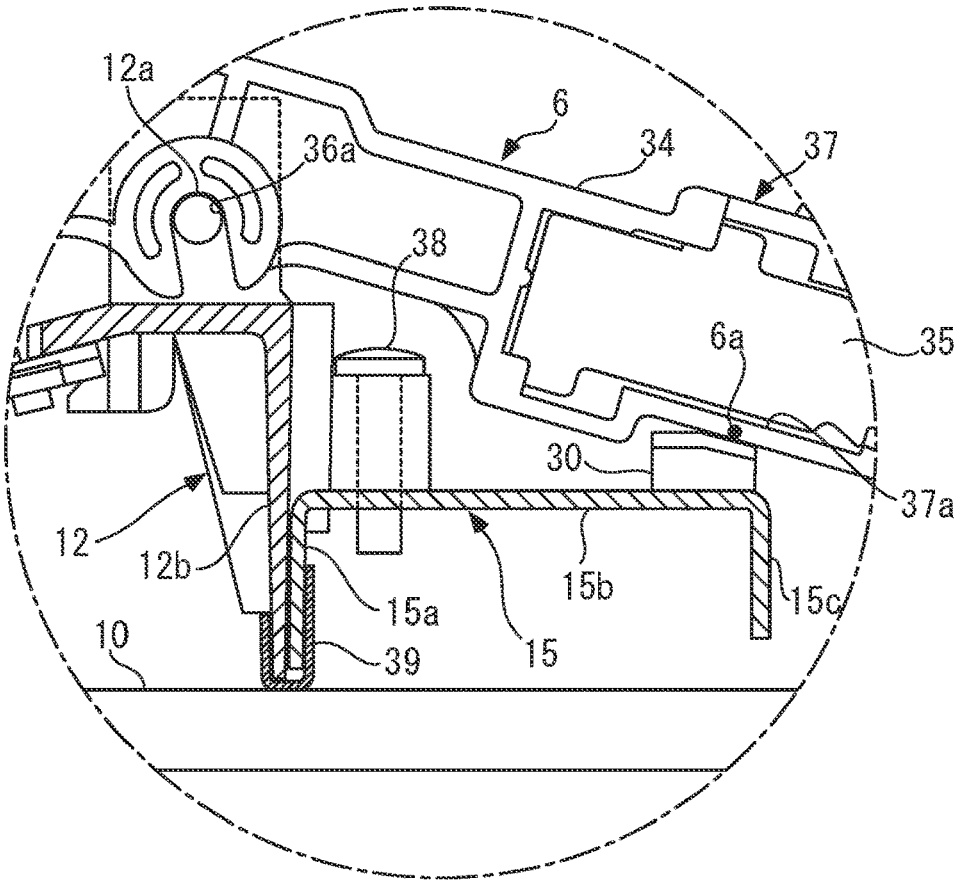

The intermediate rail 15 mounted on the chassis intermediate portion 12 as described above is disposed in a state floating from the keybed 10 as shown in FIG. 1B. More specifically, a lower end of the front wall 15*a* of the intermediate rail 15 is located at a position higher than a lower end of the drooping wall 12*b* of the chassis intermediate portion 12, and a spacing is formed between the lower end of the front wall 15*a* and a bottom surface of the clip member 39. Further, a lower end of the rear wall 15*c* of the intermediate rail 15 is located at a position higher than the keybed 10.

Further, the lower limit stopper 30, which extends along the longitudinal direction of the intermediate rail 15 (in the depth direction as viewed in FIGS. 1A and 1B) and also along the entirety of the plurality of hammers 6, is mounted on a rear end of the upper wall 15*b* of the intermediate rail 15. The lower limit stopper 30 is formed of an elastic material (e.g. foamed urethane), and has a rectangular shape in transverse cross-section. Note that although the above-described lower limit stopper 30 is formed of a single long member, it is possible to provide the lower limit stopper 30 for each hammer 6 or each plurality of hammers 6.

As described hereinabove, when the keyboard device 1 having the lower limit stopper 30 arranged on the intermediate rail 15 is in the key-released state, as shown in FIGS. 1A and 1B, a placement-contact portion 6*a* of the hammer 6 located immediately upward of the lower limit stopper 30 is placed on the lower limit stopper 30. Note that FIGS. 1A and 1B show a state in which the placement-contact portion 6*a* of the hammer 6 is placed on a rear half of the lower limit stopper 30, whereby the rear half of the lower limit stopper 30 is slightly crushed.

Figure 3A:
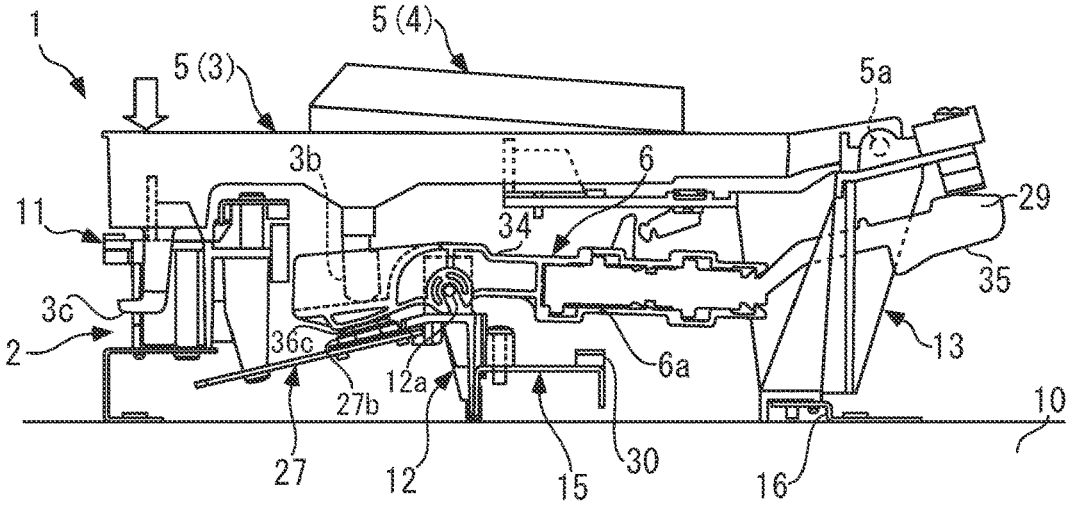

In the keyboard device 1 constructed as above, when the key 5 is depressed from the key-released state shown in FIGS. 1A and 1B, the depressed key 5 is pivotally moved in a counterclockwise direction about the pivot shaft 5*a* of the rear end of the key 5, e.g. to a state as shown in FIG. 3A in which the white key 3 is depressed. In accordance with this pivotal motion of the key 5, the actuator portion 3*b* of the key 5 presses downward the engagement recess 36*b* of the hammer 6. As a consequence, the hammer 6 presses the associated switch body 27*b* of the key switch 27 from above by the switch pressing portion 36*c* while being pivotally moved in the counterclockwise direction about the pivot shaft 12*a* of the chassis intermediate portion 12. Further, in this case, a rear end of the hammer 6 (a rear end of the weight 35) is brought into contact with the upper limit stopper 29 of the chassis rear 13 from below, whereby further pivotal motion of the hammer 6 is blocked. By the key depressing operation described above, a predetermined touch weight corresponding to the weight and torque of the hammer 6 is imparted to the key 5, and key depression information of the key 5 is detected via the key switch 27. Then, sound corresponding to the detected key depression information is output from a speaker, not shown.

Figure 3B:
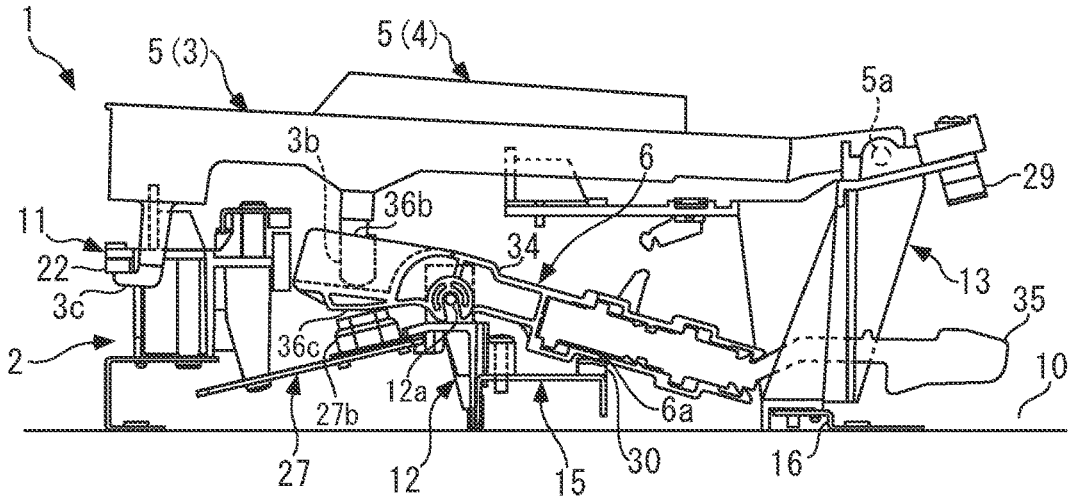

On the other hand, when the depressed key 5 is released, as shown in FIG. 3B, the hammer 6 pivotally moves about the pivot shaft 12*a*, contrary to the above, in a clockwise direction. In accordance with this pivotal motion of the hammer 6, the key 5 is pushed upward via the actuator portion 3*b*, thereby being pivotally moved about the pivot shaft 5*a*, contrary to the above, in the clockwise direction. Then, the placement-contact portion 6*a* of the hammer 6 moves into contact with the lower limit stopper 30 from above, whereby further pivotal motion of the hammer 6 is blocked, and the hammer 6 returns to its original position in the key-released state. Further, in a case where the key 5 is the white key 3, the upper limit position regulation portion 3*c* moves into contact with the white key-associated key stopper 22 from below, whereby further pivotal motion of the key 5 is blocked, and the key 5 returns to its original position in the key-released state.

Figure 4:
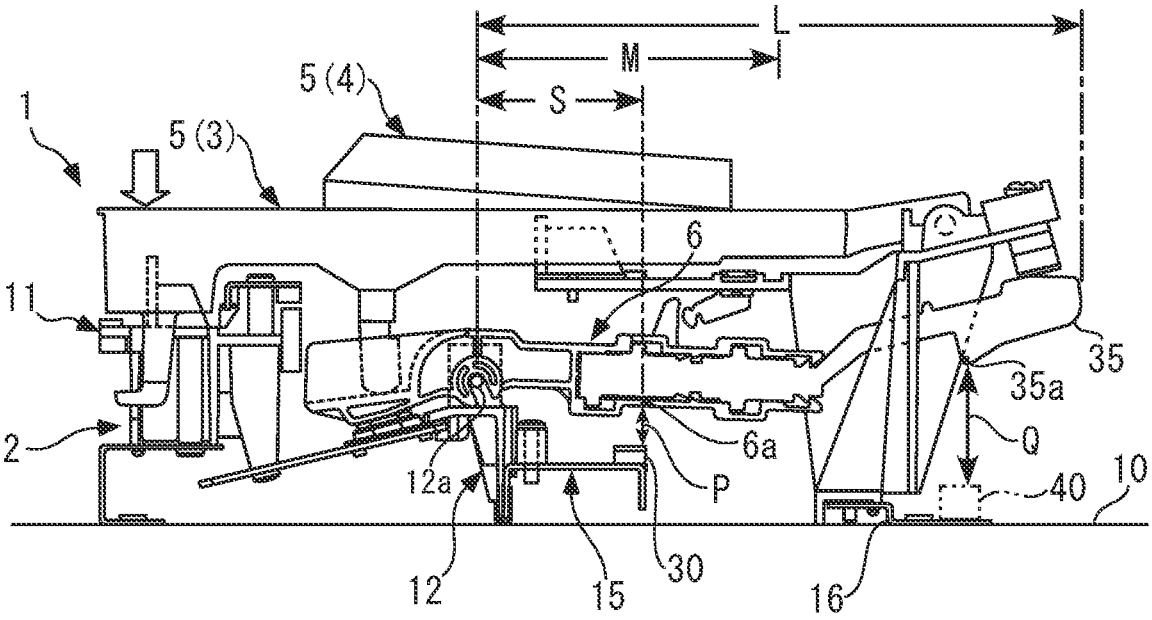
FIG. 4 is a view useful in explaining a positional relationship between the hammer and a lower limit stopper.

Now, the positional relationship between the hammer 6 and the lower limit stopper 30 will be described in more details with reference to FIG. 4. As shown in FIG. 4, the hammer 6 has a predetermined length L from the pivot shaft 12*a* to the rear end thereof. Further, a length M shown in FIG. 4 represents a length equal to half of the predetermined length L. A distance S from the pivot shaft 12*a* to the placement-contact portion 6*a* of the hammer 6 which moves into contact with the lower limit stopper 30 is shorter than the length M. That is, the lower limit stopper 30 is disposed on the intermediate rail 15 such that the placement-contact portion 6*a* of the hammer 6 is located closer to the pivot shaft 12*a* than a location corresponding to the above-mentioned length M equal to half of the predetermined length L is.

By setting the positional relationship between the hammer 6 and the lower limit stopper 30 as described above, compared with e.g. a case where a portion 35*a*, which is located closer to the rear end of the hammer 6 than a center position of the hammer 6 is, moves into contact with a lower limit stopper 40 located below the portion 35*a*, a distance P between the placement-contact portion 6*a* of the hammer 6, which is located at the upper limit position of the hammer 6 (when the hammer 6 starts to pivotally move downward), and the lower limit stopper 30, is much shorter than a distance Q between the above-mentioned portion 35*a* and the lower limit stopper 40.

As described above in detail, according to the present embodiment, the intermediate rail 15 is mounted on the keyboard chassis 2 below the pivot shaft 12*a* for the plurality of hammers 6 and its vicinity, and the lower limit stopper 30 is mounted on the intermediate rail 15. Differently from the conventional keyboard device, which has a lower limit stopper (e.g. the lower limit stopper 40 in FIG. 4) disposed at a location far away from a rotational shaft of a hammer, the lower limit stopper 30 is disposed at a location relatively close to the pivot shaft 12*a* as the rotational shaft of the hammer 6. With this, when the hammer 6 starts to pivotally move downward during key release immediately after key depression, a distance (e.g. the distance P in FIG. 4) between the placement-contact portion 6*a* and the lower limit stopper 30 is shorter compared with the case of the conventional keyboard device (e.g. the distance Q in FIG. 4), and hence the speed of the hammer 6 and impact thereof on the lower limit stopper 30 when the placement-contact portion 6*a* of the hammer 6 moves into contact with the lower limit stopper 30 are reduced. As a result, compared with the conventional keyboard device, it is possible to reduce noise generated by the contact. Further, the intermediate rail 15 having the lower limit stopper 30 mounted thereon is mounted on the keyboard chassis 2 in the state floating from the keybed 10, so that when the hammer 6 pivotally moves downward into contact with the lower limit stopper 30, vibration and noise generated by the contact cannot be directly transmitted to the keybed 10. As described above, the lower limit stopper 30 with which the hammer 6 moves into contact is disposed below the pivot shaft 12*a* for the hammer 6 and its vicinity and is also mounted on the intermediate rail 15 in the state floating from the keybed 10, whereby compared with the conventional keyboard device, it is possible to largely reduce noise generated by the contact of the hammer 6 with the lower limit stopper 30.

Further, since the lower limit stopper 30 is formed of an elastic material, it is possible to absorb impact on the lower limit stopper 30 when the hammer 6 is brought into contact therewith, to thereby further reduce noise generated by the contact.

Note that the present invention is not limited to the above-described embodiment, but it can be practiced in various forms. For example, although in the above-described embodiment, the keyboard device 1 of the present invention is applied to an electronic piano, the present invention is not limited to this, but it can be applied to other keyboard instruments. Further, details of the constructions of the keyboard chassis 2, the keys 5, the hammers 6, the intermediate rail 15, and the lower limit stopper 30 shown in the embodiment are given only by way of example, and they can be changed as appropriate within the scope of the subject matter of the present invention.

What is claimed is:

1. A keyboard device for a keyboard instrument, comprising:

a keybed;

a keyboard chassis disposed on the keybed;

a plurality of keys each extending in a front-rear direction and pivotally supported on the keyboard chassis, the keys being arranged side by side in a left-right direction;

a plurality of hammers each extending in the front-rear direction and pivotally supported on the keyboard chassis below the plurality of keys, the hammers being arranged side by side in the left-right direction and being vertically pivotally moved in accordance with depression of associated ones of the keys, respectively;

an extension rail extending below a rotational shaft of the plurality of hammers and their vicinities along an entirety of the plurality of hammers in the left-right direction, the extension rail being mounted on the keyboard chassis in a state floating from the keybed; and a lower limit stopper which is mounted on the extension rail and on which each of the plurality of hammers is placed via a predetermined placement-contact portion thereof when in a key-released state, the lower limit stopper blocking further pivotal motion of the hammer by having the hammer contact itself from above when the hammer pivotally moved upward by key depression pivotally moves downward in accordance with key release.

2. The keyboard device according to claim 1, wherein the lower limit stopper extends along a longitudinal direction of the extension rail and is disposed along the entirety of the plurality of hammers.

3. The keyboard device according to claim 1, wherein each of the plurality of hammers has a predetermined length from the rotational shaft to a rear end thereof, and wherein the lower limit stopper is disposed on the extension rail such that the placement-contact portion of the hammer is located closer to the rotational shaft than a location corresponding to half of the predetermined length is.

4. The keyboard device according to claim 1, wherein the lower limit stopper is formed of an elastic material.

* * * * *